US007256666B2

(12) United States Patent
Uchida et al.

(10) Patent No.: US 7,256,666 B2
(45) Date of Patent: Aug. 14, 2007

(54) BAND REJECTION FILTER WITH ATTENUATION POLES

(75) Inventors: Hiromitsu Uchida, Tokyo (JP); Moriyasu Miyazaki, Tokyo (JP); Yoshihiko Imai, Tokyo (JP); Norio Umemura, Tokyo (JP); Junko Nakayama, Kanagawa (JP); Hirotaka Kamino, Kanagawa (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/785,983

(22) Filed: Feb. 26, 2004

(65) Prior Publication Data

US 2004/0178866 A1 Sep. 16, 2004

(51) Int. Cl.
*H01P 1/20* (2006.01)
*H01P 1/203* (2006.01)
*H01P 1/207* (2006.01)

(52) U.S. Cl. ..... 333/202; 204/208

(58) Field of Classification Search ..... 333/175, 333/176, 202, 204, 208, 212
See application file for complete search history.

(56) References Cited

U.S. PATENT DOCUMENTS

| | | | | |
|---|---|---|---|---|
| 4,423,396 | A * | 12/1983 | Makimoto et al. | 333/204 |
| 4,449,108 | A * | 5/1984 | Endo et al. | 333/202 |
| 4,477,785 | A * | 10/1984 | Atia | 333/202 |
| 4,757,288 | A * | 7/1988 | West | 333/206 |
| 5,184,096 | A * | 2/1993 | Wakino et al. | 333/175 |
| 5,888,942 | A * | 3/1999 | Matthaei | 505/210 |
| 5,896,073 | A * | 4/1999 | Miyazaki et al. | 333/204 |
| 2001/0054943 | A1* | 12/2001 | Takeda | 333/204 |

FOREIGN PATENT DOCUMENTS

| | | | |
|---|---|---|---|
| JP | 52-075953 | F | 6/1977 |
| JP | 03-155201 | | 7/1991 |
| JP | 04-068609 | | 3/1992 |
| JP | 61-33503 | | 5/1994 |
| JP | 07094908 | A * | 4/1995 |
| JP | 09-232809 | | 9/1997 |

OTHER PUBLICATIONS

Hong et al., Microstip Filters For RF/Microwave Application, John Wiley & Sons, Inc., 2001, pp. 168-176.*
H. Uchida, et al. "Ku-band Elliptic-Function Band-Rejection Filter with Dielectric Resonators", Sep. 23-26, 2003; IEICE Electronics Society Conference, C-2-82.
H. Uchida, et al. "Dielectric Resonator Elliptic-Function Band Rejection Filter with External Coupling Waveguide", Oct. 2003, 33rd European Microwave Conference, pp. 183-185.
G.L. Matthaei, et al., "Microwave Filters, Impedance-Matching Networks, and Coupling Structures", Artech House, p. 735, 1964.

* cited by examiner

*Primary Examiner*—Seungsook Ham
(74) *Attorney, Agent, or Firm*—Birch, Stewart, Kolasch & Birch, LLP

(57) ABSTRACT

A band rejection filter with attenuation poles includes a plurality of series resonant circuits having end terminals connected in common and other end terminals connected in series via a plurality of transmission lines each having a length that is an odd multiple of about the one-quarter wavelength at the resonance frequency of the plurality of series resonant circuits, and a jump-coupling circuit for roughly coupling two of the plurality of series resonant circuits, which are not adjacent to each other, to each other.

16 Claims, 8 Drawing Sheets

- Background Art -

BAND REJECTION FILTER WITH ATTENUATION POLES

BACKGROUND OF THE INVENTION

1. Field of the Invention

The present invention relates to a band rejection filter with attenuation poles that is provided with two or more resonant circuits.

2. Description of Related Art

Conventionally, band rejection filters provided with two or more resonant circuits are known (for example, refer to "Microwave Filters, Impedance-Matching Networks, and Coupling Structures", G. Matthaei, et al., Artech House Publishers, 1980, pp. 735). In general, a band rejection filter is provided with two or more series resonant circuits 200 connected in series via a transmission line 201, as shown in FIG. 11. The transmission line 201 is the one that has a length equal to the one-quarter wavelength at the resonance frequency of the two or more series resonant circuits 200. The band rejection filter is also provided with an input/output terminal 203 having an impedance Zo.

Since the electric nodes of each series resonant circuit 200 are electrically short-circuited at the resonance frequency of the two or more series resonant circuits 200, the band rejection filter exhibits characteristics of having an infinite attenuation at the resonance frequency of the two or more series resonant circuits 200 and having a limited attenuation in the vicinity of the resonance frequency. A problem with the conventional band rejection filter mentioned above is that in some cases the number of series resonant circuits required to obtain a desired attenuation in a certain frequency band has to be increased and therefore the circuit scale has to be increased. Another problem is that a so-called attenuation pole that provides a maximum attenuation is always formed only at the resonance frequency of the plurality of resonant circuits, and it is therefore difficult to provide a sufficient attenuation in a frequency range of frequencies close to the resonance frequency.

SUMMARY OF THE INVENTION

The present invention is made in order to solve the above-mentioned problems, and it is therefore an object of the present invention to provide a band rejection filter with attenuation poles that can improve its attenuation characteristics over a desired frequency band, and can reduce the number of resonant circuits included in the band rejection filter, thereby reducing the circuit scale.

In accordance with an aspect of the present invention, there is provided a band rejection filter with attenuation poles including a plurality of series resonant circuits having end terminals connected in common and other end terminals connected in series via a plurality of transmission lines each having a length that is an odd multiple of about a one-quarter wavelength at a resonance frequency of the plurality of series resonant circuits, and a non-adjacent coupling circuit for roughly coupling two of the plurality of series resonant circuits, which are not adjacent to each other, to each other.

Therefore, the aspect of the present invention offers an advantage of being able to improve the attenuation characteristics of the band rejection filter with attenuation poles over a desired frequency band, and to reduce the number of resonant circuits included in the band rejection filter, thereby reducing the circuit scale of the band rejection filter.

In accordance with another aspect of the present invention, there is provided a band rejection filter with attenuation poles including a plurality of parallel resonant circuits connected in series via a plurality of transmission lines each having a length that is an odd multiple of about a one-quarter wavelength at a resonance frequency of the plurality of parallel resonant circuits, and a jump-coupling circuit for roughly coupling two of the plurality of parallel resonant circuits, which are not adjacent to each other, to each other.

Therefore, the other aspect of the present invention offers an advantage of being able to improve the attenuation characteristics of the band rejection filter with attenuation poles over a desired frequency band, and to reduce the number of resonant circuits included in the band rejection filter, thereby reducing the circuit scale of the band rejection filter.

Further objects and advantages of the present invention will be apparent from the following description of the preferred embodiments of the invention as illustrated in the accompanying drawings.

DETAILED DESCRIPTION OF THE PREFERRED EMBODIMENTS

The preferred embodiment of the invention will now be described with reference to the accompanying drawings.

Embodiment 1

Figure 1:
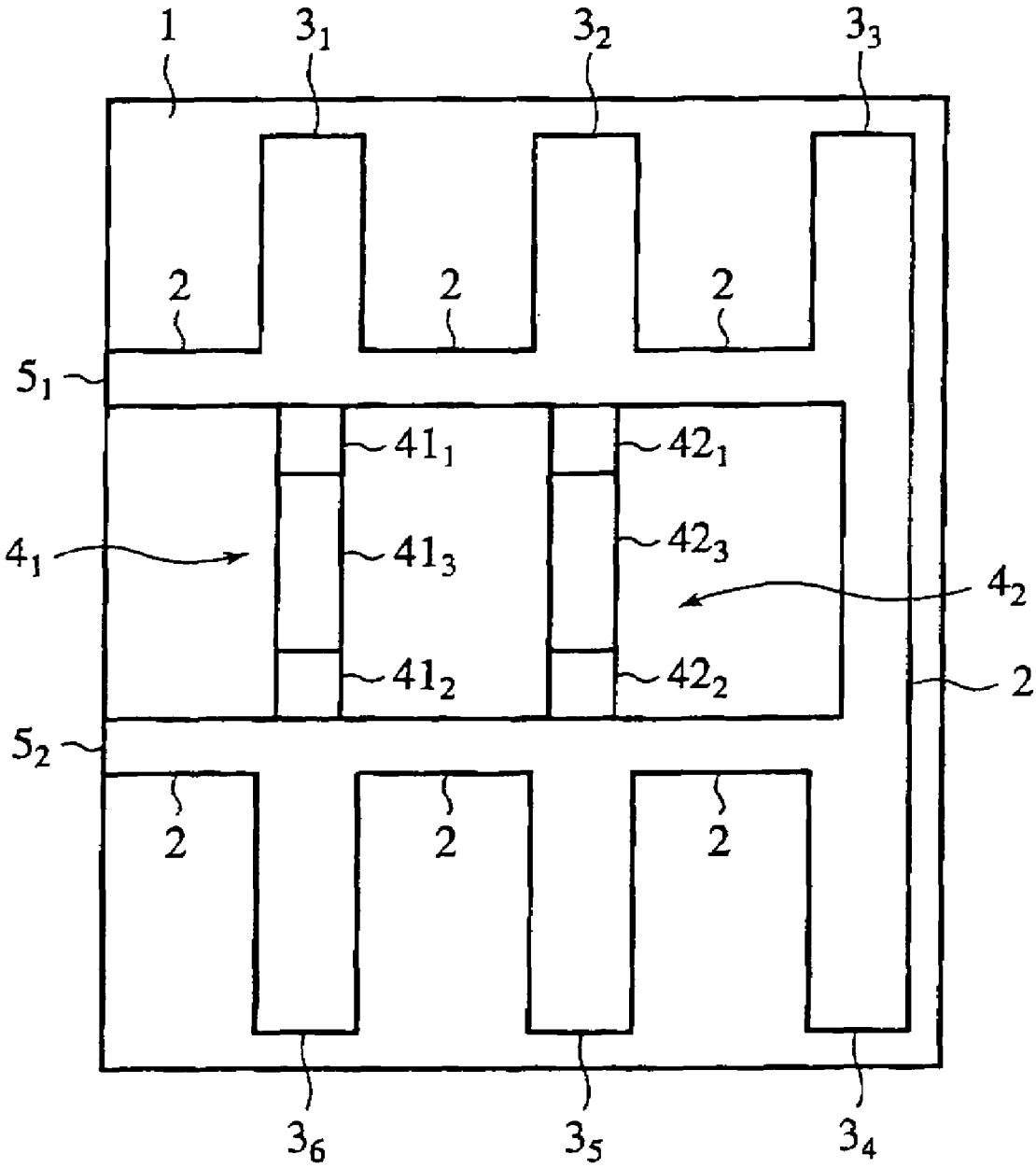
FIG. 1 is a plan view showing the structure of a band rejection filter with attenuation poles in accordance with embodiment 1 of the present invention.

FIG. 1 is a plan view showing the structure of a band rejection filter with attenuation poles in accordance with embodiment 1 of the present invention. The band rejection filter with attenuation poles includes a transmission line 2 and a plurality of open-ended stubs $\mathbf{3}_1$ to $\mathbf{3}_6$, each of which is formed of a microstrip line on a dielectric substrate 1, and jump-coupling circuits $\mathbf{4}_1$ and $\mathbf{4}_2$ formed on the dielectric substrate 1.

The transmission line 2 is formed of two parallel line segment patterns having ends connected to each other and other ends that are open. The open ends of the transmission line 2 are used as input/output terminals $\mathbf{5}_1$ and $\mathbf{5}_2$.

Each of the plurality of open-ended stubs $\mathbf{3}_1$ to $\mathbf{3}_6$ functions as a series resonant circuit. Each of the plurality of open-ended stubs $\mathbf{3}_1$ to $\mathbf{3}_6$ has a length equal to the one-quarter wavelength at the resonance frequency of the series resonant circuit, and is projecting to outside from the transmission line 2. In accordance with the present invention, each of the open-ended stubs 31 to 36 does not need to strictly have a length equal to the one-quarter wavelength and can alternatively have a length that is an odd multiple of about the one-quarter wavelength. In this case, an intended result is produced. Therefore, "the one-quarter wavelength", which is simply described in this specification, means "an odd multiple of about the one-quarter wavelength". The plurality of open-ended stubs $\mathbf{3}_1$ to $\mathbf{3}_6$ are arranged at predetermined intervals of the one-quarter wavelength at the resonance frequency of the plurality of series resonant circuits.

The first jump-coupling circuit $\mathbf{4}_1$ is arranged between the first open-ended stub $\mathbf{3}_1$ and the sixth open-ended stub $\mathbf{3}_6$, and the second jump-coupling circuit $\mathbf{4}_2$ is arranged between the second open-ended stub $\mathbf{3}_2$ and the fifth open-ended stub $\mathbf{3}_5$.

The first jump-coupling circuit $\mathbf{4}_1$ includes a capacitor $\mathbf{4}_1$, a transmission line $\mathbf{41}_3$, and another capacitor $\mathbf{41}_2$ which are connected in series. The capacitor $\mathbf{41}_1$ has the same structure as the other capacitor $\mathbf{41}_2$, and they are both chip capacitors. The transmission line $\mathbf{41}_3$ is formed of a microstrip line having a length equal to the one-quarter wavelength at the resonance frequency of the plurality of series resonant circuits.

Similarly, the second jump-coupling circuit $\mathbf{4}_2$ includes a capacitor $\mathbf{42}_1$, a transmission line $\mathbf{42}_3$, and another capacitor $\mathbf{42}_2$ which are connected in series. The capacitor $\mathbf{42}_1$ has the same structure as the other capacitor $\mathbf{42}_2$, and they are both chip capacitors. The transmission line $\mathbf{42}_3$ is formed of a microstrip line having a length equal to the one-quarter wavelength at the resonance frequency of the plurality of series resonant circuits. Each of those jump-coupling circuits $\mathbf{4}_1$ and $\mathbf{4}_2$ constitutes an admittance inverter mentioned later.

In the band rejection filter with attenuation poles according to this embodiment 1, each of the above-mentioned capacitors $\mathbf{41}_1$, $\mathbf{41}_2$, $\mathbf{42}_1$, and $\mathbf{42}_2$ consists of a chip capacitor. As an alternative, each of the above-mentioned capacitors $\mathbf{41}_1$, $\mathbf{41}_2$, $\mathbf{42}_1$, and $\mathbf{42}_2$ can consist of either a gap capacitor formed as a gap of the transmission line, or an interdigital capacitor. Each of the transmission lines 2, $\mathbf{41}_3$ and $\mathbf{42}_3$ is formed of a microstrip line. As an alternative, each of the transmission lines 2, $\mathbf{41}_3$ and $\mathbf{42}_3$ can be formed of either a slot line or a coplanar line.

Figure 2A:
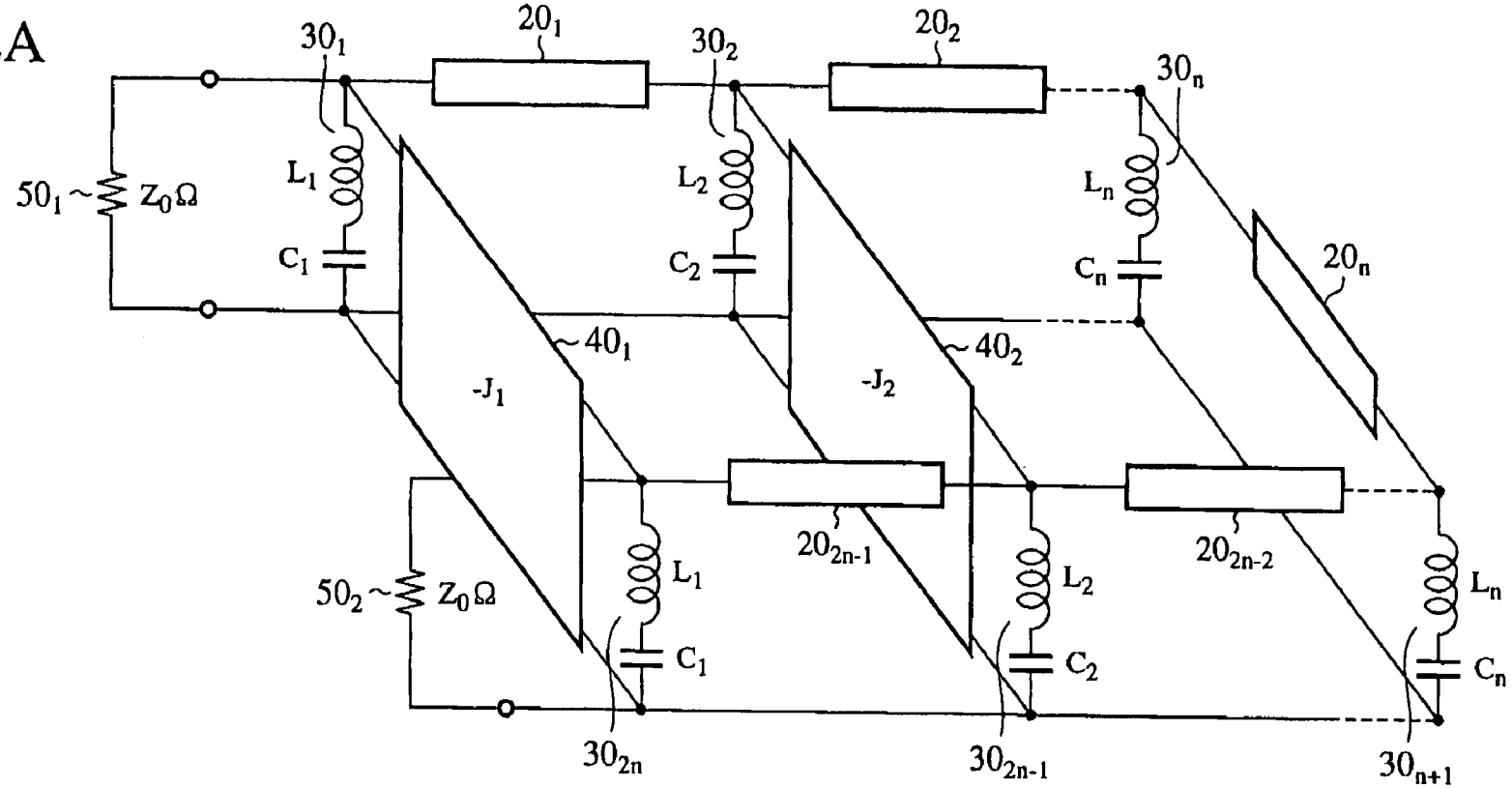
FIGS. 2A and 2B are diagrams showing an equivalent circuit of the band rejection filter with attenuation poles in accordance with embodiment 1 of the present invention.

In general, the band rejection filter with attenuation poles can be represented by an equivalent circuit as shown in FIG. 2A. In other words, the band rejection filter with attenuation poles includes 2n (n is an integer number equal to or larger than 2) series resonant circuits $\mathbf{30}_1$ to $\mathbf{30}_{2n}$ having terminals that are connected in common (for example, that are grounded), and other terminals that are connected in series via a plurality of transmission lines $\mathbf{20}_1$ to $\mathbf{20}_{2n-1}$ each having a length equal to the one-quarter wavelength at the resonance frequency of the plurality of series resonant circuits. The band rejection filter with attenuation poles having the structure as shown in FIG. 1 corresponds to an example of the equivalent circuit of FIG. 2A in which "n" is set to "3".

A first admittance inverter $\mathbf{40}_1$ comprised of the first jump-coupling circuit $\mathbf{4}_1$ is connected between the first series resonant circuit $\mathbf{30}_1$ and the 2n-th series resonant circuit $\mathbf{30}_{2n}$, and a second admittance inverter $\mathbf{40}_2$ comprised of the second jump-coupling circuit $\mathbf{4}_2$ is connected between the second series resonant circuit 302 and the (2n−1)-th series resonant circuit $\mathbf{30}_{2n-1}$. The parameter J values of the first admittance inverter $\mathbf{40}_1$ and the parameter J values of the second admittance inverter $\mathbf{40}_2$ are both negative, and are represented by "$-J_1$" and "$-J_2$", respectively.

Input/output terminals $\mathbf{50}_1$ and $\mathbf{50}_2$ each having a source impedance Zo are connected to the first and 2n-th series resonant circuits $\mathbf{30}_1$ and $\mathbf{30}_{2n}$, respectively.

Figure 3A:
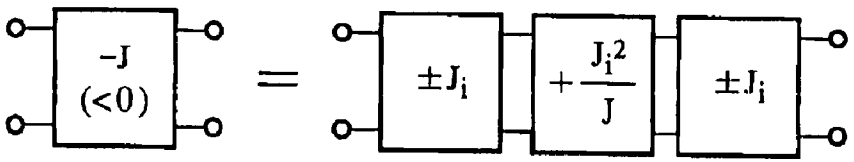
FIGS. 3A to 3C are diagrams showing an equivalent circuit of an admittance inverter used by the band rejection filter with attenuation poles in accordance with embodiment 1 of the present invention.

In general, each of the first and second admittance inverters $\mathbf{40}_1$ and $\mathbf{40}_2$ having negative parameter J values, as shown in the equivalent circuit of FIG. 2A, can be expressed by admittance inverters "$\pm J_i$", "$J_i^2/J$" and "$\pm J_i$", which are connected in series, as shown in FIG. 3A. In general, an admittance inverter is approximately implemented via either a transmission line having a length equal to the one-quarter wavelength or a circuit including an in-series capacitor.

Figure 3B:
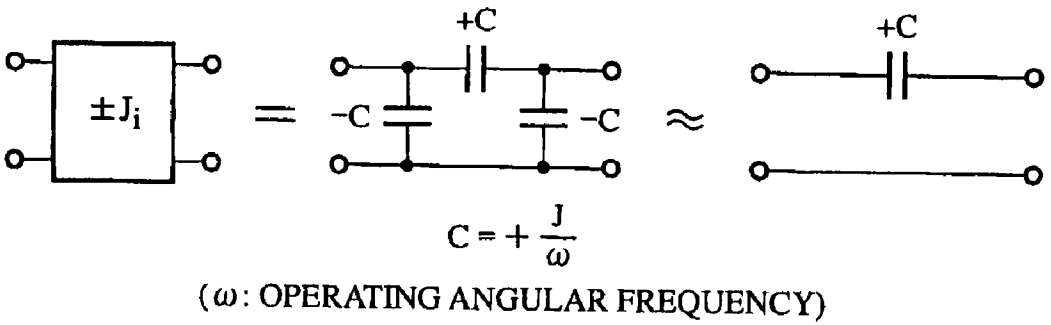
Figure 3C:
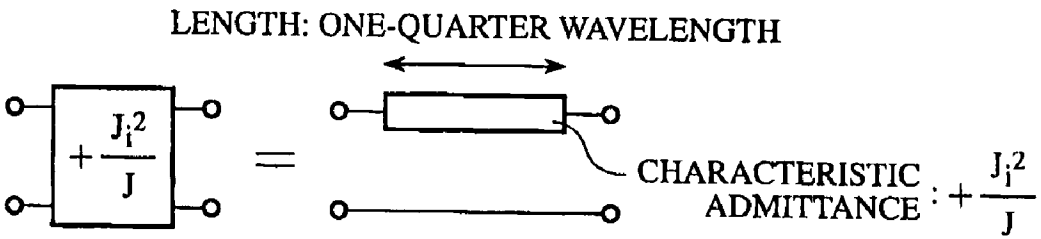

Therefore, the above-mentioned admittance inverter $\pm J_i$ can be approximately replaced by an in-series capacitor having a capacitance value of $J_i/\omega$ ($\omega$ is an operating angular frequency), as shown in FIG. 3B. The admittance inverter $J_i^2/J$ can be approximately replaced by a transmission line having a length equal to the one-quarter wavelength and a characteristic admittance $J_i^2/J$, as shown in FIG. 3C. As a result, when "n" is "3", the band rejection filter with attenuation poles represented by the equivalent circuit of FIG. 2A can have a structure as shown in FIG. 1. In other words, the circuitry having the structure as shown in FIG. 1 exhibits the characteristics of band rejection filters with poles.

Figure 2B:
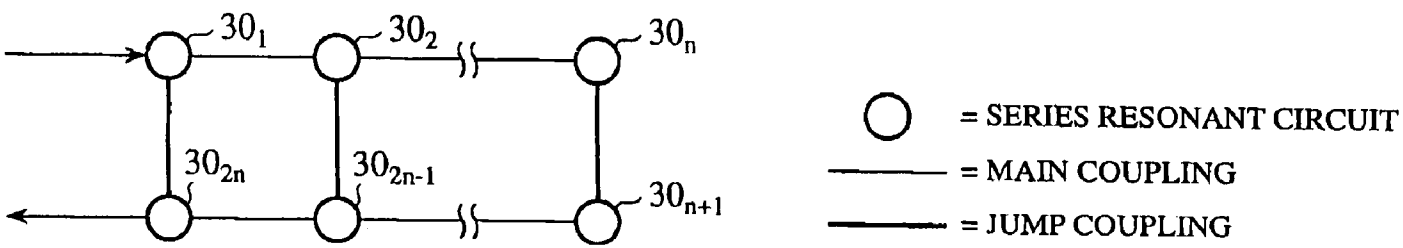

The equivalent circuit of the band rejection filter with attenuation poles as shown in FIG. 2A can be shown by a further-simplified block diagram shown in FIG. 2B. The band rejection filter with attenuation poles shown in FIG. 2B contains, as coupling among the plurality of series resonant circuits $\mathbf{30}_1$ to $\mathbf{30}_{2n}$, a plurality of main couplings each between two adjacent series resonant circuits and a plurality of non-adjacent couplings between two series resonant circuits that are not adjacent to each other. The band rejection filter with attenuation poles according to this embodiment 1 is thus characterized in that it has a plurality of jump couplings each for providing coupling between two series resonant circuits that are not adjacent to each other in addition to a plurality of main couplings each for providing coupling between two adjacent series resonant circuits, as shown in FIG. 2B. Those jump-couplings provide two or more paths along which electromagnetic waves propagate among the plurality of series resonant circuits, and, when the electromagnetic waves are of opposite phase with one another, an attenuation pole is formed and therefore the components propagating through the paths cancel one another out.

Figure 4:
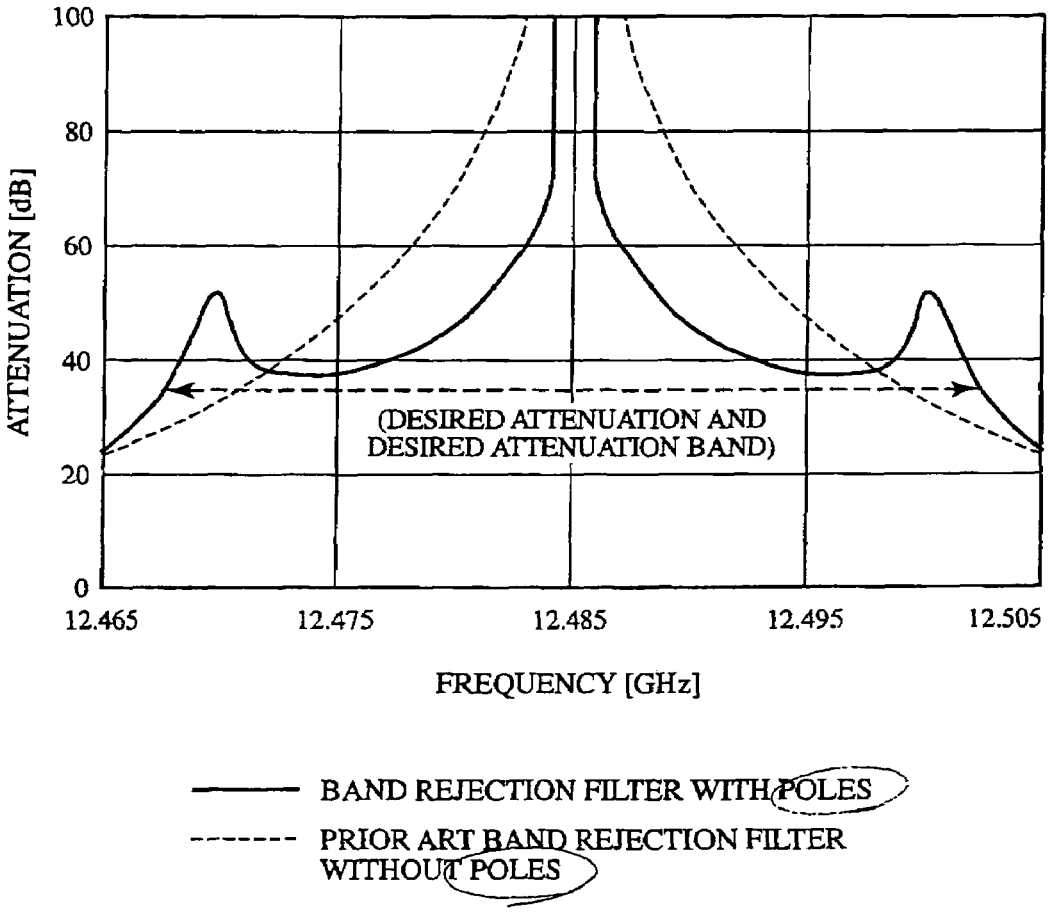
FIG. 4 is a diagram showing an example of calculation of the characteristics of the band rejection filter with attenuation poles in accordance with embodiment 1 of the present invention.

FIG. 4 shows an example of calculation of the characteristics of the band rejection filter with attenuation poles having four stages. It is clear from this figure that the band rejection filter with attenuation poles produces attenuation poles that provide a minimum amount of pass through on both sides of the resonance frequency of the series resonant circuits. FIG. 4 also shows the characteristics of a band rejection filter without poles having the same number of stages, band width, and reflection loss as the band rejection filter with attenuation poles mentioned above using a dashed line. It is clear from the figure that the band rejection filter with attenuation poles that is so formed as to have jump couplings can provide a desired attenuation for a desired attenuation band.

As previously explained, according to this embodiment 1, the first and sixth series resonant circuits $\mathbf{3}_1$ and $\mathbf{3}_6$ that are not adjacent to each other are coupled to each other via the first jump-coupling circuit $\mathbf{4}_1$ in which a capacitor $\mathbf{41}_1$, a transmission line $\mathbf{41}_3$ having a length equal to the one-quarter wavelength, and another capacitor $\mathbf{41}_2$ are connected in series, and the second and fifth series resonant circuits $\mathbf{3}_2$ and $\mathbf{3}_5$ that are not adjacent to each other are coupled to each other via the second jump-coupling circuit $\mathbf{4}_2$ in which a capacitor $\mathbf{42}_1$, a transmission line $\mathbf{42}_3$ having a length equal to the one-quarter wavelength, and another capacitor $\mathbf{42}_2$ are connected in series. Therefore, a band rejection filter with attenuation poles having two or more attenuation poles in its filter characteristics can be implemented. As a result, since the number of filters required for providing a desired attenuation can be reduced, the downsizing of the circuitry can be achieved.

Embodiment 2

A band rejection filter with attenuation poles according to embodiment 2 of the present invention employs jump-coupling circuits in each of which a high impedance line, a low impedance line, and another high impedance line are connected in series, instead of the jump-coupling circuits according to embodiment 1.

Figure 5:
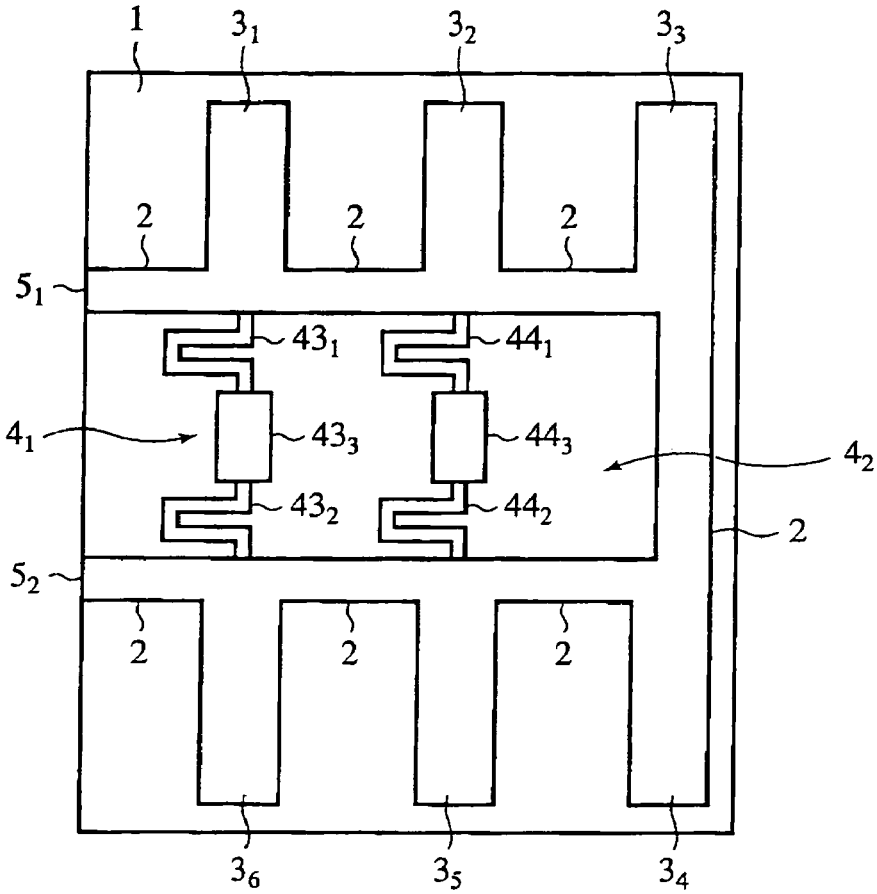
FIG. 5 is a plan view showing the structure of a band rejection filter with attenuation poles in accordance with embodiment 2 of the present invention.

FIG. 5 is a plan view showing the structure of the band rejection filter with attenuation poles in accordance with this embodiment 2. The same components as those of embodiment 1 or like components are designated by the same reference numerals as shown in embodiment 1, and therefore the explanation of those components will be omitted hereafter.

A first jump-coupling circuit $\mathbf{4}_1$ includes a high impedance line $\mathbf{43}_1$, a low impedance line $\mathbf{43}_3$, and another high impedance line $\mathbf{43}_2$ that are connected in series. The two high impedance lines $\mathbf{43}_1$ and $\mathbf{43}_2$ have their respective bent portions that are formed so that their impedances are increased, and each of them is formed of a microstrip line having a length equal to the one-quarter wavelength at the resonance frequency of series resonant circuits. The low impedance line $\mathbf{43}_3$ is formed of a linear microstrip line having a length equal to the one-quarter wavelength at the resonance frequency of the series resonant circuits.

A second jump-coupling circuit $\mathbf{4}_2$ includes a high impedance line $\mathbf{44}_1$, a low impedance line $\mathbf{44}_3$, and another high impedance line $\mathbf{44}_2$ that are connected in series. The two high impedance lines $\mathbf{44}_1$ and $\mathbf{44}_2$ have their respective bent portions that are formed so that their impedances are increased, and each of them is formed of a microstrip line having a length equal to the one-quarter wavelength at the resonance frequency of the series resonant circuits. The low impedance line $\mathbf{44}_3$ is formed of a linear microstrip line having a length equal to the one-quarter wavelength at the resonance frequency of the series resonant circuits.

In the band rejection filter with attenuation poles according to this embodiment 2, each of the above-mentioned high impedance lines $\mathbf{43}_1$, $\mathbf{43}_2$, $\mathbf{44}_1$, and $\mathbf{44}_2$ and the above-mentioned low impedance lines $\mathbf{43}_3$ and $\mathbf{44}_3$ is formed of a microstrip line, as previously mentioned. As an alternative, each of them can be formed of either a slot line or a coplanar line.

When the admittance inverter $\pm J_i$, which is already explained with reference to FIG. 3, is formed of a line having a high impedance and a length equal to the one-quarter wavelength at the resonance frequency of the series resonant circuits, instead of a capacitor adopted by above-mentioned embodiment 1, the admittance inverter $J_i^2/J$ can be implemented via a line having a low impedance and a length equal to the one-quarter wavelength at the resonance frequency of the series resonant circuits because J of the admittance inverter $J_i^2/J$ generally becomes sufficiently small. Thus, each jump-coupling circuit of the band rejection filter with attenuation poles is constructed of a high impedance line, a low impedance line, and another high impedance line, each of which has a length equal to the one-quarter wavelength at the resonance frequency of the band rejection filter, and which are connected in series.

As previously explained, according to this embodiment 2, the first and sixth series resonant circuits $\mathbf{3}_1$ and $\mathbf{3}_6$ that are not adjacent to each other are coupled to each other via the first jump-coupling circuit $\mathbf{4}_1$ in which a high impedance line $\mathbf{43}_1$, a low impedance line $\mathbf{43}_3$, and another high impedance line $\mathbf{43}_2$, each of which has a length equal to the one-quarter wavelength at the resonance frequency of the plurality of series resonant circuits, are connected in series, and the second and fifth series resonant circuits $\mathbf{3}_2$ and $\mathbf{3}_5$ that are not adjacent to each other are coupled to each other via the second jump-coupling circuit $\mathbf{4}_2$ in which a high impedance line $\mathbf{44}_1$, a low impedance line $\mathbf{44}_3$, and another high impedance line $\mathbf{44}_2$, each of which has a length equal to the one-quarter wavelength at the resonance frequency of the plurality of series resonant circuits, are connected in series. Therefore, a band rejection filter with attenuation poles having two or more attenuation poles in its filter characteristics can be implemented. As a result, since the number of filters required for providing a desired attenuation can be reduced, the downsizing of the circuitry can be achieved.

Embodiment 3

A band rejection filter with attenuation poles according to embodiment 3 of the present invention employs jump-coupling circuits in each of which a microstrip line having a length sufficiently shorter than the wavelength at the resonance frequency of a plurality of series resonant circuits, a capacitor, and another microstrip line having a length sufficiently shorter than the wavelength at the resonance frequency of the plurality of series resonant circuits are connected in series, instead of the jump-coupling circuits according to embodiment 1.

Figure 6:
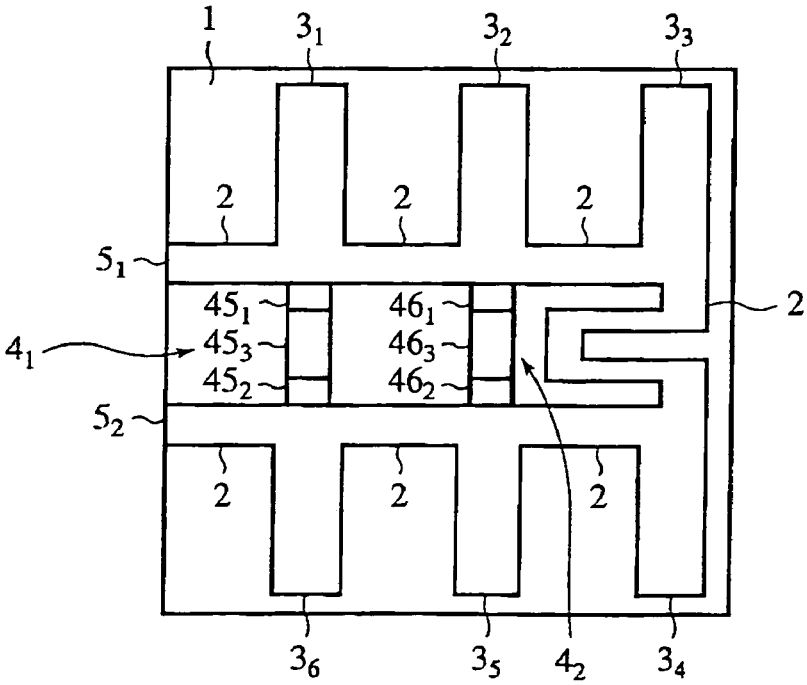
FIG. 6 is a plan view showing the structure of a band rejection filter with attenuation poles in accordance with embodiment 3 of the present invention.

FIG. 6 is a plan view showing the structure of the band rejection filter with attenuation poles in accordance with this embodiment 3. The same components as those of embodiment 1 or like components are designated by the same reference numerals as shown in embodiment 1, and therefore the explanation of those components will be omitted hereafter.

A first jump-coupling circuit $\mathbf{4}_1$ is constructed of a microstrip line $\mathbf{45}_1$, a capacitor $\mathbf{45}_3$, and another microstrip line $\mathbf{45}_2$, which are connected in series. The first microstrip line $45_1$ has the same structure as the second microstrip line $45_2$, and they have a length sufficiently shorter than the wavelength at the resonance frequency of the plurality of series resonant circuits. The capacitor $45_3$ consists of a chip capacitor.

Similarly, a second jump-coupling circuit $4_2$ is constructed of a microstrip line $46_1$, a capacitor $46_3$, and another microstrip line $46_2$, which are connected in series. The first microstrip line $46_1$ has the same structure as the second microstrip line $46_2$, and they have a length sufficiently shorter than the wavelength at the resonance frequency of the plurality of series resonant circuits. The capacitor $46_3$ consists of a chip capacitor.

In the first jump-coupling circuit $4_1$, the two microstrip lines $45_1$ and $45_2$ are formed so that the implementation of the capacitor $45_3$ is facilitated for connecting a first open-ended stub $3_1$ with a sixth open-ended stub $3_6$ via the capacitor $45_3$. Similarly, in the second jump-coupling circuit $4_2$, the two microstrip lines $46_1$ and $46_2$ are formed so that the implementation of the capacitor $46_3$ is facilitated for connecting a second open-ended stub $3_2$ with a fifth open-ended stub $3_5$ via the capacitor $46_3$. In some cases, these microstrip lines $45_1$, $45_2$, $46_1$, and $46_2$ can be omitted.

In the band rejection filter with attenuation poles according to this embodiment 3, each of the above-mentioned capacitors $45_3$ and $46_3$ consists of a chip capacitor. As an alternative, each of the above-mentioned capacitors $45_3$ and $46_3$ can consist of either a gap capacitor formed as a gap of a transmission line or an interdigital capacitor. Each of the transmission lines 2, $45_1$, $45_2$, $46_1$ and $46_2$ is formed of a microstrip line. As an alternative, each of the transmission lines 2, $45_1$, $45_2$, $46_1$ and $46_2$ can be formed of either a slot line or a coplanar line.

The band rejection filter with attenuation poles according to this embodiment 3 uses capacitors as first and second admittance inverters $40_1$ and $40_2$ each of which couples two of a plurality of series resonant circuits $30_1$ to $30_{2n}$, as shown in FIG. 2, which are not adjacent to each other, to each other. As previously explained with reference to FIG. 3, an admittance inverter having a negative parameter value of "$-J_i$" can be approximately replaced by a capacitor having a capacitance value of $J_i/\omega$ ($\omega$ is an operating angular frequency). Thus each jump-coupling circuit of the band rejection filter with attenuation poles can be implemented via a capacitor.

As previously explained, according to this embodiment 3, the first and sixth series resonant circuits $3_1$ and $3_6$ that are not adjacent to each other are coupled to each other via the first jump-coupling circuit $4_1$ provided with a capacitor $45_3$, and the second and fifth series resonant circuits $3_2$ and $3_5$ that are not adjacent to each other are coupled to each other via the second jump-coupling circuit $4_2$ provided with a capacitor $46_3$. Therefore, a band rejection filter with attenuation poles having two or more attenuation poles in its filter characteristics can be implemented. As a result, since the number of filters required for providing a desired attenuation can be reduced, the downsizing of the circuitry can be achieved.

Embodiment 4

Figure 7A:
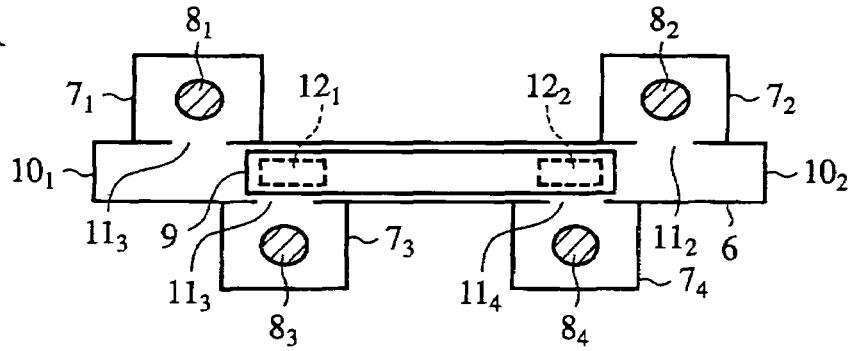
FIGS. 7A and 7B are a cross-sectional view and a top plan view showing the structure of a band rejection filter with attenuation poles in accordance with embodiment 4 of the present invention.
Figure 7B:
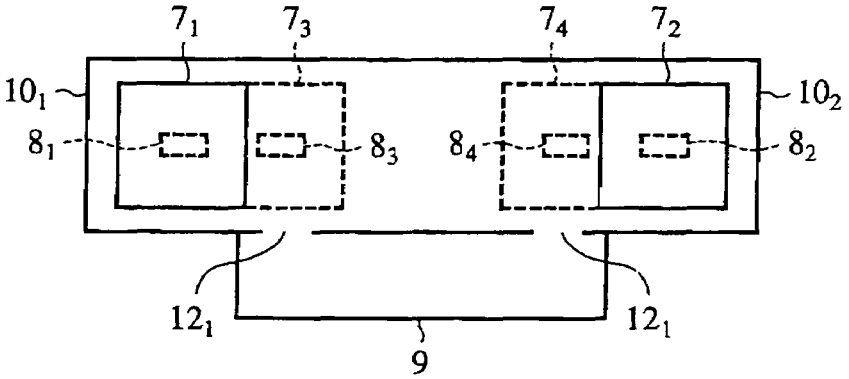

FIGS. 7A and 7B are diagrams showing the structure of a band rejection filter with attenuation poles according to embodiment 4 of the present invention. FIG. 7A is a cross-sectional view of the band rejection filter with attenuation poles and FIG. 7B is a top plan view of the band rejection filter with attenuation poles. The band rejection filter with attenuation poles includes first and second metallic cavities $7_1$ and $7_2$ disposed on an upper wider wall face of a main waveguide 6, third and fourth metallic cavities $7_3$ and $7_4$ disposed on a lower wider wall face of the main waveguide 6, first through fourth dielectric resonators $8_1$ to $8_4$ contained in the first through fourth metallic cavities $7_1$ to $7_4$, respectively, and a non-adjacent coupling waveguide 9 formed on a narrower wall face of the main waveguide 6.

The jump-coupling waveguide 9 has a width (i.e., a waveguide length) that is set so that the electric length thereof becomes about 90 degrees at the resonance frequency of the first through fourth dielectric resonators $8_1$ to $8_4$. Both ends of the main waveguide 6 are used as input/output terminals $10_1$ and $10_2$. A plurality of coupling holes $11_1$ to $11_4$ are formed between the main waveguide 6 and the first through fourth metallic cavities $7_1$ to $7_4$, respectively. Two coupling holes $12_1$ and $12_2$ are also formed between the main waveguide 6 and the jump-coupling waveguide 9 and serve as a capacitor and another capacitor according to the present invention, respectively.

Figure 8:
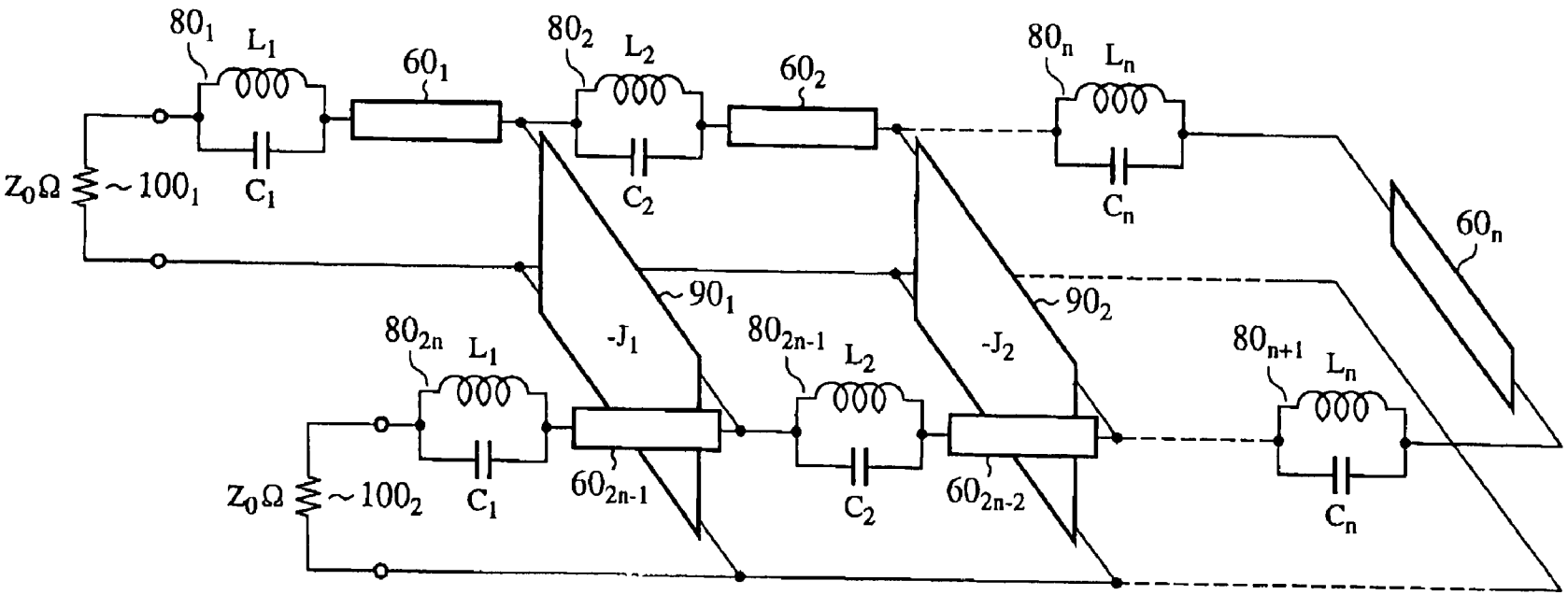
FIG. 8 is a circuit diagram showing an equivalent circuit of the band rejection filter with attenuation poles in accordance with embodiment 4 of the present invention.

Next, the operation of the band rejection filter with attenuation poles will be explained. The equivalent circuit of the band rejection filter with attenuation poles according to embodiment 1, as shown in FIG. 2A, which includes a plurality of series resonant circuits, can be transformed into a band rejection filter with attenuation poles, as shown in FIG. 8, which includes a plurality of parallel resonant circuits. In this band rejection filter with attenuation poles, the plurality of parallel resonant circuits $80_1$ to $80_{2n}$ are connected in series via a plurality of transmission lines $60_1$ to $60_{2n-1}$ each having a length equal to of the one-quarter wavelength at the resonance frequency of the plurality of parallel resonant circuits.

A first admittance inverter $90_1$ comprised of the jump-coupling waveguide 9 is connected between the first and 2n-th parallel resonant circuits $80_1$ and $80_{2n}$, and a second admittance inverter $90_2$ comprised of the jump-coupling waveguide 9 is connected between the second and (2n−1)-th parallel resonant circuits $80_2$ and $80_{2n-1}$. Both the parameter J values of the first admittance inverter $90_1$ and the parameter J values of the second admittance inverter $90_2$ are both negative, and are represented by "$-J_1$" and "$-J_2$", respectively.

Input/output terminals $100_1$ and $100_2$ having source impedance Zo are disposed in the first and 2n-th parallel resonant circuits $80_1$ and $80_{2n}$, respectively.

On the other hand, in the band rejection filter with attenuation poles shown in FIG. 7, the plurality of metallic cavities $7_1$ to $7_4$ and the plurality of dielectric resonators $8_1$ to $8_4$ operate as parallel resonant circuits, respectively. Since the jump-coupling waveguide 9 and the coupling holes $12_1$ and $12_2$ operate as a line having a length equal to the one-quarter wavelength at the resonance frequency of the parallel resonant circuits and capacitors, respectively, these components have the same functionality as the jump-coupling circuits of the band rejection filter with attenuation poles according to embodiment 1. Since the band rejection filter with attenuation poles having the structure as shown in FIG. 7 has the same characteristics as the band rejection filter with attenuation poles as shown in FIG. 8, i.e., the band rejection filter with attenuation poles as shown in FIG. 2A, the band rejection filter with attenuation poles having the structure as shown in FIG. 7 exhibits the same characteristics as the band rejection filter with attenuation poles in accordance with embodiment 1.

As previously explained, according to this embodiment 4, the two parallel resonant circuits that are not adjacent to each other are coupled to each other via the coupling holes $12_1$ and $12_2$ and the jump-coupling waveguide 9 that are provided on a narrower wall face of the main waveguide 6. Therefore, a band rejection filter with attenuation poles having two or more attenuation poles in its filter characteristics can be implemented. As a result, since the number of filters required for providing a desired attenuation can be reduced, the downsizing of the circuitry can be achieved.

Embodiment 5

A band rejection filter with attenuation poles according to embodiment 5 of the present invention employs a waveguide having a high impedance, a waveguide having a low impedance, and another waveguide having a high impedance that are connected in series, instead of the jump-coupling waveguide in accordance with embodiment 4.

Figure 9A:
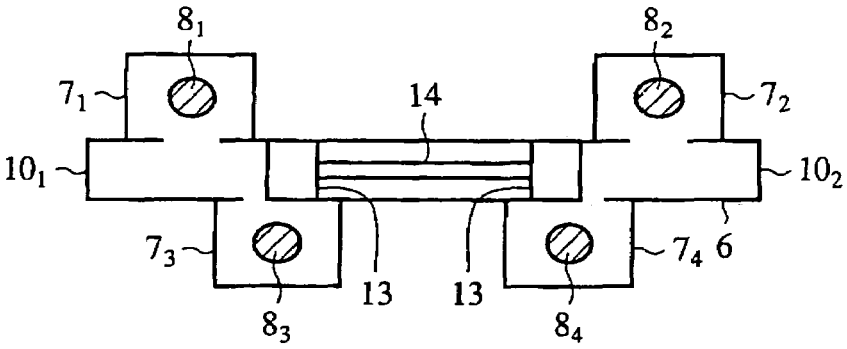
FIGS. 9A and 9B are a cross-sectional view and a top plan view showing the structure of a band rejection filter with attenuation poles in accordance with embodiment 5 of the present invention.
Figure 9B:
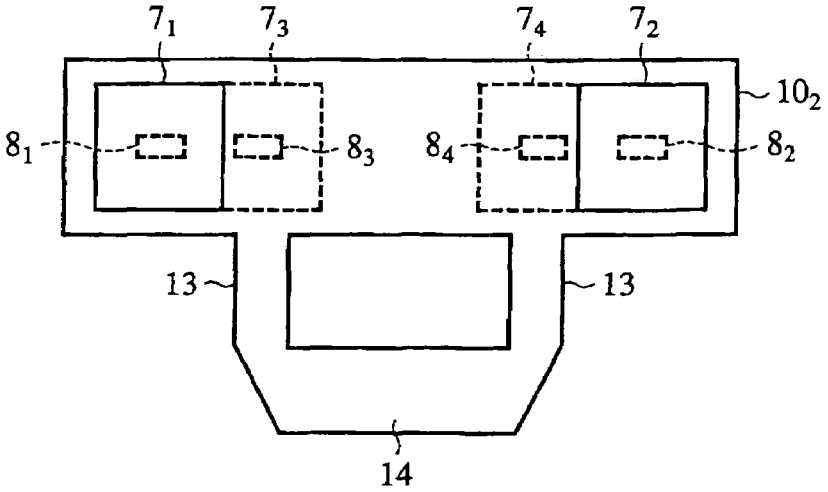

FIGS. 9A and 9B are views showing the structure of the band rejection filter with attenuation poles according to this embodiment 5, FIG. 9A is a cross-sectional view of the band rejection filter with attenuation poles, and FIG. 9B is a plan view of the band rejection filter with attenuation poles. The same components as those of embodiment 4 or like components are designated by the same reference numerals as shown in embodiment 1, and therefore the explanation of those components will be omitted hereafter.

As shown in FIGS. 9A and 9B, the band rejection filter with attenuation poles according to this embodiment 5 is provided with two narrower and thicker jump-coupling waveguides 13 each having a high impedance which are connected to one narrower wall face of a main waveguide 6, and a wider and thinner jump-coupling waveguide 14 having a low impedance connected between the two narrower and thicker jump-coupling waveguides 13, instead of the jump-coupling waveguide 9 according to embodiment 4. The waveguide lengths of these waveguides are so set that their electric lengths become about 90 degrees at the resonance frequency of a plurality of dielectric resonators $8_1$ to $8_4$.

Next, the operation of the band rejection filter with attenuation poles according to embodiment 5 of the present invention will be explained. The band rejection filter with attenuation poles according to this embodiment 5 uses a plurality of parallel resonant circuits instead of the plurality of series resonant circuits according to embodiment 2, uses the main waveguide 6 instead of transmission lines, and further uses the jump-coupling waveguides 13 and 14 instead of jump-coupling circuits. Therefore, the equivalent circuit of the band rejection filter with attenuation poles according to embodiment 5 is the same as the band rejection filter with attenuation poles as shown in FIG. 8, and exhibits the same filter characteristics as that of embodiment 4. In other words, the structure as shown in FIG. 9 can implement a band rejection filter with attenuation poles having the filtering features of the present invention.

As previously explained, according to this embodiment 5, the two parallel resonant circuits that are not adjacent to each other are coupled to each other via a waveguide in which a jump-coupling waveguide 13 having a high impedance and an electric length of about 90 degrees, a jump-coupling waveguide 14 having a low impedance, and another jump-coupling waveguide 13 having a high impedance are connected in series. Therefore, a band rejection filter with attenuation poles having two or more attenuation poles in its filter characteristics can be implemented. As a result, since the number of filters required for providing a desired attenuation can be reduced, the downsizing of the circuitry can be achieved.

Embodiment 6

A band rejection filter with attenuation poles according to embodiment 6 of the present invention is the one in which a plurality of series resonant circuits $30_1$ to $30_6$ (i.e., a plurality of open-ended stubs $3_1$ to $3_6$) of embodiment 3 are replaced by a plurality of parallel resonant circuits $15_1$ to $15_6$ which are embedded in a transmission line 2.

Figure 10:
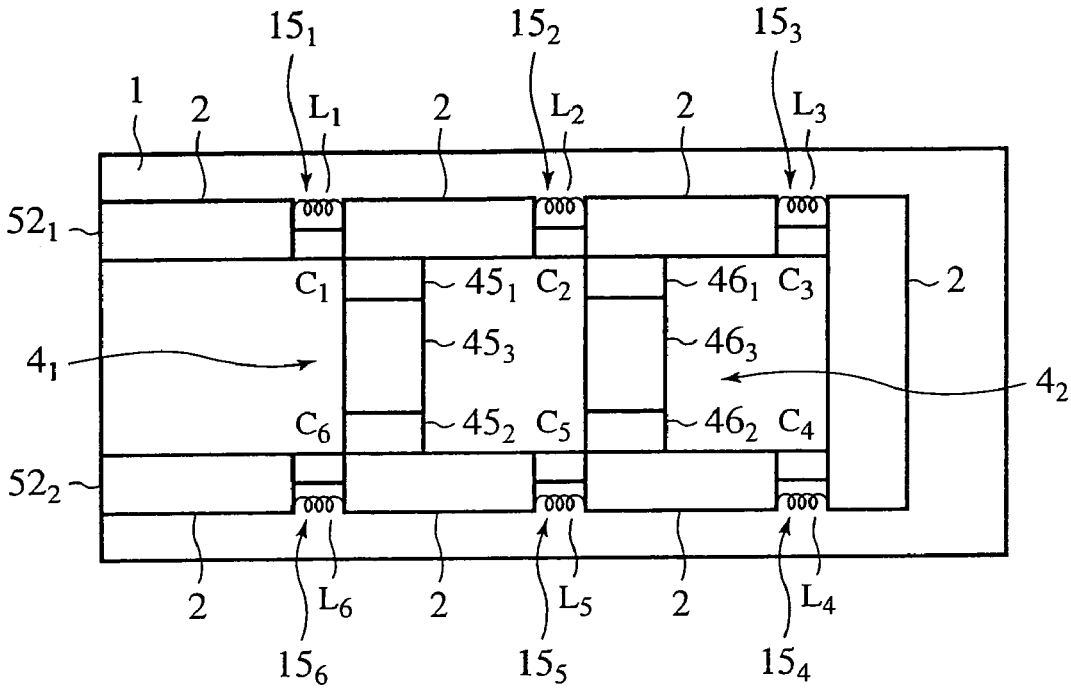
FIG. 10 is a plan view showing the structure of a band rejection filter with attenuation poles in accordance with embodiment 6 of the present invention.
Figure 11:
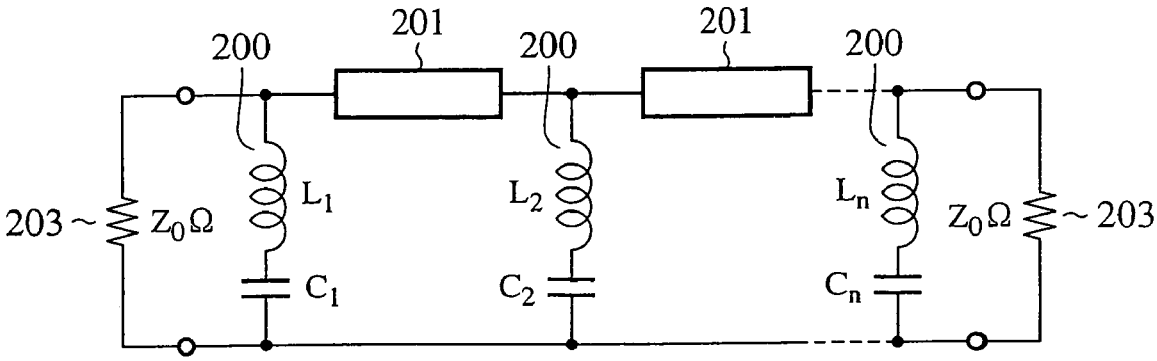
FIG. 11 is a diagram for explaining a prior art band rejection filter.

FIG. 10 is a plan view showing the structure of the band rejection filter with attenuation poles according to this embodiment 6. The same components as those of embodiment 3 or like components are designated by the same reference numerals as shown in embodiment 1, and therefore the explanation of those components will be omitted hereafter.

In the band rejection filter with attenuation poles according to this embodiment, the plurality of parallel resonant circuits $15_1$ to $15_6$ are embedded in the transmission line 2 and at intervals of a length equal to the one-quarter wavelength at the resonance frequency of the plurality of parallel resonant circuits. Each of the plurality of parallel resonant circuits $15_1$ to $15_6$ is constructed of a corresponding one of coils $L_1$ to $L_6$, which serves as an inductor, and a corresponding one of chip capacitors $C_1$ to $C_6$, the pair of coil and chip capacitor being connected in parallel.

Next, the operation of the band rejection filter with attenuation poles in accordance with this embodiment 6 of the present invention will be explained. The band rejection filter with attenuation poles according to embodiment 6 uses the plurality of parallel resonant circuits instead of the plurality of series resonant circuits of the band rejection filter with attenuation poles in accordance with embodiment 3. The equivalent circuit of the band rejection filter with attenuation poles in accordance with this embodiment 6 is the same as the equivalent circuit of the band rejection filter with attenuation poles shown in FIG. 9, and exhibits the same filter characteristics as the band rejection filter with attenuation poles according to embodiment 3. In other words, the structure as shown in FIG. 10 can implement a band rejection filter with attenuation poles having the filtering features of the present invention.

As previously explained, according to this embodiment 6, the first and sixth parallel resonant circuits that are not adjacent to each other are coupled to each other via the first jump-coupling waveguide $4_1$ provided with a capacitor $45_3$ and the second and fifth parallel resonant circuits that are not adjacent to each other are coupled to each other via the second jump-coupling waveguide $4_2$ provided with a capacitor $46_3$. Therefore, a band rejection filter with attenuation poles having two or more attenuation poles in its filter characteristics can be implemented. As a result, since the number of filters required for providing a desired attenuation can be reduced, the downsizing of the circuitry can be achieved.

As previously mentioned, the band rejection filter with attenuation poles according to embodiment 6 is the one in which the plurality of series resonant circuits $30_1$ to $30_6$ of the band rejection filter with attenuation poles in accordance with embodiment 3 are replaced by the plurality of parallel resonant circuits $15_1$ to $15_6$. As an alternative, the band rejection filter with attenuation poles according to embodiment 6 can be the one in which the plurality of series resonant circuits $30_1$ to $30_6$ of the band rejection filter with attenuation poles in accordance with embodiment 1 or 2 are replaced by the plurality of parallel resonant circuits $15_1$ to $15_6$. The band rejection filter with attenuation poles of this variant operates in the same way as that according to above-mentioned embodiment 1 or 2, and this variant offers the same advantage as provided by above-mentioned embodiment 1 or 2.

Many widely different embodiments of the present invention may be constructed without departing from the spirit and scope of the present invention. It should be understood that the present invention is not limited to the specific embodiments described in the specification, except as defined in the appended claims.

What is claimed is:

1. A band rejection filter with attenuation poles comprising:

a plurality of series resonant circuits with one set of end terminals having a common connection which is an equipotential node, and another set of end terminals, each connected through via separate transmission lines each having a length that is an odd multiple of about a one-quarter wavelength corresponding to a resonance frequency of the plurality of series resonant circuits; and a jump-coupling circuit for coupling pairs of non-adjacent series resonant circuits, belonging to the plurality of series resonant circuits, to each other.

2. The band rejection filter with attenuation poles according to claim 1, wherein said jump-coupling circuit includes a capacitor, a transmission line having a length that is an odd multiple of about the one-quarter wavelength at the resonance frequency of the plurality of series resonant circuits, and another capacitor, which are connected in series.

3. The band rejection filter with attenuation poles according to claim 2, wherein each of said plurality of transmission lines, said plurality of series resonant circuits, and said transmission line included in said jump-coupling circuit is formed of a microstrip line, a slot line, or a coplanar line, which is formed on a dielectric substrate, and each of said capacitor and said other capacitor consists of a chip capacitor, a gap capacitor formed of a transmission line, or an interdigital capacitor.

4. The band rejection filter with attenuation poles according to claim 1, wherein said jump-coupling circuit includes a high impedance line having a length that is an odd multiple of about the one-quarter wavelength at the resonance frequency of the plurality of series resonant circuits, a low impedance line having substantially the same length as said high impedance line, and another high impedance line having substantially the same length as said high impedance line, which are connected in series.

5. The band rejection filter with attenuation poles according to claim 4, wherein each of said plurality of transmission lines, said plurality of series resonant circuits, said high impedance line, said low impedance line, and said other high impedance line is formed of a microstrip line, a slot line, or a coplanar line which is formed on a dielectric substrate.

6. The band rejection filter with attenuation poles according to claim 1, wherein said jump-coupling circuit includes a capacitor.

7. The band rejection filter with attenuation poles according to claim 6, wherein each of said plurality of transmission lines and said plurality of series resonant circuits is formed of a microstrip line, a slot line, or a coplanar line, which is formed on a dielectric substrate, and said capacitor consists of a chip capacitor, a gap capacitor formed of a transmission line, or an interdigital capacitor.

8. A band rejection filter with attenuation poles comprising:

a plurality of parallel resonant circuits each connected to one of a pair of transmission lines having a length that is an odd multiple of about a one-quarter wavelength corresponding to a resonance frequency of the plurality of parallel resonant circuits; and a jump-coupling circuit for coupling two parallel resonant circuits, belonging to different transmission lines, to each other.

9. The band rejection filter with attenuation poles according to claim 8, wherein said jump-coupling circuit includes a capacitor, each of said pair of transmission lines having a length that is an odd multiple of about the one-quarter wavelength at the resonance frequency of the plurality of parallel resonant circuits, and another capacitor, which are connected in series.

10. The band rejection filter with attenuation poles according to claim 9, wherein each of said pair of transmission lines included in said jump-coupling circuit is formed of a microstrip line, a slot line, or a coplanar line, which is formed on a dielectric substrate, and each of said capacitor and said other capacitor consists of a chip capacitor, a gap capacitor formed of a transmission line, or an interdigital capacitor.

11. The band rejection filter with attenuation poles according to claim 9, said pair of transmission lines consist of a rectangular waveguide, each of said plurality of parallel resonant circuits consists of a dielectric resonator that is electromagnetically coupled, via a coupling hole formed in a wider wall face of said rectangular waveguide, with said rectangular waveguide, each of said pair of transmission lines included in said jump-coupling circuit consists of a jump-coupling waveguide disposed in a narrower wall face of said rectangular waveguide, and each of said capacitor and said other capacitor consists of a coupling hole formed in the narrower wall face of said rectangular waveguide.

12. A band rejection filter with attenuation poles comprises:

a plurality of parallel resonant circuits each connected through separate transmission lines having a length that is an odd multiple of about a one-quarter wavelength corresponding to a resonance frequency of the plurality of parallel resonant circuits; and a jump-coupling circuit for coupling two non adjacent parallel resonant circuits, belonging to the plurality of parallel resonance circuits, to each other, wherein said jump-coupling circuit includes a high impedance line having a length that is an odd multiple of about the one-quarter wavelength at the resonance frequency of the plurality of parallel resonant circuits, a low impedance line having substantially the same length as said high impedance line, and another high impedance line having substantially the same length as said high impedance line, which are connected in series.

13. The band rejection filter with attenuation poles according to claim 12, wherein each of said plurality of transmission lines, said high impedance line, said low impedance line, and said other high impedance line is formed of a microstrip line, a slot line, or a coplanar line which is formed on a dielectric substrate.

14. The band rejection filter with attenuation poles according to claim 12, wherein said plurality of transmission lines consist of a rectangular waveguide, each of said plurality of parallel resonant circuits consists of a dielectric resonator that is electromagnetically coupled, via a coupling hole formed in a wider wall face of said rectangular waveguide, with said rectangular waveguide, each of said high impedance line and said other high impedance line consists of a narrower and thicker jump-coupling waveguide disposed in a narrower wall face of said rectangular waveguide, and said low impedance line consists of a wider and thinner jump-coupling waveguide disposed in the narrower wall face of said rectangular waveguide.

15. The band rejection filter with attenuation poles according to claim 8, wherein said jump-coupling circuit includes a capacitor.

16. The band rejection filter with attenuation poles according to claim 15, wherein each of said pair of transmission lines is formed of a microstrip line, a slot line, or a coplanar line, which is formed on a dielectric substrate, and said capacitor consist of a chip capacitor, a gap capacitor formed of a transmission line, or an interdigital capacitor.

* * * * *